US012344953B2

(12) United States Patent
Nakajima et al.

(10) Patent No.: US 12,344,953 B2
(45) **Date of Patent: *Jul. 1, 2025**

(54) ELECTROLYTIC COPPER FOIL

(71) Applicant: MITSUI MINING & SMELTING CO., LTD., Tokyo (JP)

(72) Inventors: Daisuke Nakajima, Ageo (JP); Yasuji Hara, Ageo (JP); Mitsuyoshi Matsuda, Ageo (JP); Mitsuhiro Wada, Ageo (JP)

(73) Assignee: MITSUI MINING & SMELTING CO., LTD., Tokyo (JP)

( * ) Notice: Subject to any disclaimer, the term of this patent is extended or adjusted under 35 U.S.C. 154(b) by 319 days.

This patent is subject to a terminal disclaimer.

(21) Appl. No.: 17/795,369

(22) PCT Filed: Jan. 14, 2021

(86) PCT No.: PCT/JP2021/001103

§ 371 (c)(1),
(2) Date: Jul. 26, 2022

(87) PCT Pub. No.: WO2021/153257

PCT Pub. Date: Aug. 5, 2021

(65) Prior Publication Data

US 2023/0074384 A1 Mar. 9, 2023

(30) Foreign Application Priority Data

Jan. 30, 2020 (JP) ..... 2020-013720

(51) Int. Cl.
*C25D 1/04* (2006.01)

(52) U.S. Cl.
CPC ..... *C25D 1/04* (2013.01)

(58) Field of Classification Search
None
See application file for complete search history.

(56) References Cited

U.S. PATENT DOCUMENTS 5,421,985 A 6/1995 Clouser et al.
5,454,926 A 10/1995 Clouser et al.
(Continued)

FOREIGN PATENT DOCUMENTS

CN 110093637 A 8/2019
EP 0 675 213 A1 10/1995
(Continued)

*Primary Examiner* — Seth Dumbris
(74) *Attorney, Agent, or Firm* — GREENBLUM & BERNSTEIN, P.L.C.

(57) ABSTRACT

Provided is an electrodeposited copper foil having high smoothness and at the same time exhibiting high flexibility (particularly, high flexibility after annealing at 180° C. for 1 hour) suitable for a flexible substrate. This electrodeposited copper foil has a ten-point average roughness Rz of 0.1 μm or larger and 2.0 μm or smaller on at least one surface, has a tensile strength measured in accordance with IPC-TM-650 of 56 kgf/mm$^2$ or more and less than 65 kgf/mm$^2$ in an unannealed original state, and has a tensile strength measured in accordance with IPC-TM-650 of 15 kgf/mm$^2$ or more and less than 25 kgf/mm$^2$ after annealing at 180° C. for 1 hour.

4 Claims, 2 Drawing Sheets

(56) References Cited

U.S. PATENT DOCUMENTS

| | | | | |
|---|---|---|---|---|
| 6,194,056 | B1 * | 2/2001 | Sakai | H05K 1/09 428/209 |
| 6,231,742 | B1 | 5/2001 | Sano et al. | |
| 2006/0191798 | A1 | 8/2006 | Sano et al. | |
| 2006/0210823 | A1 | 9/2006 | Sano et al. | |
| 2009/0095515 | A1 * | 4/2009 | Sakai | C25D 7/0614 428/607 |
| 2009/0142607 | A1 * | 6/2009 | Narui | B29C 48/08 428/458 |
| 2009/0166213 | A1 * | 7/2009 | Dobashi | C25D 3/38 205/296 |
| 2010/0038115 | A1 * | 2/2010 | Matsuda | C25D 3/38 174/257 |
| 2014/0342178 | A1 | 11/2014 | Saito | |

FOREIGN PATENT DOCUMENTS

| | | | |
|---|---|---|---|
| JP | 05-502062 | A | 4/1993 |
| JP | 07-268678 | A | 10/1995 |
| JP | 10-330983 | A | 12/1998 |
| JP | 2004-263289 | A | 9/2004 |
| JP | 2004-339558 | A | 12/2004 |
| JP | 2006-52441 | A | 2/2006 |
| JP | 3850155 | B | 11/2006 |
| JP | 2018-178261 | A | 11/2018 |
| TW | I546420 | B | 8/2016 |
| WO | 91/019024 | A1 | 12/1991 |
| WO | 2012/002526 | A1 | 1/2012 |
| WO | 2014/104233 | A1 | 7/2014 |
| WO | 2014/119355 | A1 | 8/2014 |
| WO | 2015/016271 | A1 | 2/2015 |

* cited by examiner

| | Ex.7* | Ex.4* | Ex.5* | Ex.6* | Ex.8* | Ex.9* | Ex.10* | Ex.11 |
|---|---|---|---|---|---|---|---|---|
| TSAH | 29.9 | 33.7 | 31.8 | 27.9 | 29.2 | 28.2 | 32.6 | 28.8 |
| POVLC | 1.7% | 5.0% | 34.5% | 34.6% | 52.8% | 54.5% | 59.5% | 62.6% |
| EBSD IQ+IPF (ND) |  |  |  |  |  |  |  |  |

| | Ex.3 | Ex.1 | Ex.2 |
|---|---|---|---|
| TSAH | 21.3 | 22.4 | 24.1 |
| POVLC | 63.3% | 70.8% | 72.0% |
| EBSD IQ+IPF (ND) |  |  |  |

TSAH: Tensile strength after heating
POVLC: Proportion of vertically long crystals The symbol * represents a comparative example.
A unit of the tensile strength after heating is kgf/mm$^2$.

ELECTROLYTIC COPPER FOIL

TECHNICAL FIELD

The present invention relates to an electrodeposited copper foil, particularly to an electrodeposited copper foil used for a flexible substrate.

BACKGROUND ART

Known as an electrodeposited copper foil for a printed wiring board is a copper foil containing chlorine as low as possible (hereinafter, referred to as a chlorine-free copper foil). For example, Patent Literature 1 (JP2006-52441A) discloses a copper foil with a Cl content of less than 30 ppm in an unprocessed copper foil. Patent Literature 2 (JPH7-268678A) discloses an electrodeposited copper foil in which each peak value of X-ray diffraction intensities of (111) planes and (220) planes measured from the electrolysis end surface side satisfies a predetermined condition, and disclosed is manufacturing this electrodeposited copper foil by using a copper electrolyte with regulating a lead ion concentration to 3 ppm or less, a tin ion concentration to 6 ppm or less, a chloride ion concentration to 2 ppm or less, a silicon ion concentration to 15 ppm or less, a calcium ion concentration to 30 ppm or less, and an arsenic ion concentration to 7 ppm or less.

In addition, known technique is that a small amount of chloride ion is added into a copper plating solution during foil formation to attempt to improve characteristics from conventional chlorine-free copper foils. For example, Patent Literature 3 (JP2018-178261A) discloses an electrodeposited copper foil in which (a) brightness L* value on an unroughened side is 75 to 90 based on the L*a*b color system and (b) a tensile strength is 40 kgf/mm$^2$ or more and 55 kgf/mm$^2$ or less. It is described that a low angle granular boundary (LAGB) measured by electron backscatter diffraction (EBSD) is preferably less than 7.0% in percentage. This literature describes manufacturing the electrodeposited copper foil by using a plating solution having a chloride ion concentration of 10 ppm, 15 ppm, or 20 ppm, and using a current density of 60 A/dm$^2$, 70 A/dm$^2$, or 80 A/dm$^2$ in an initial copper-plating process.

CITATION LIST

Patent Literature

Patent Literature 1: JP2006-52441A
Patent Literature 2: JPH7-268678A
Patent Literature 3: JP2018-178261A

SUMMARY OF INVENTION

For a copper foil used for a flexible substrate, differing from a copper foil used for a rigid substrate, flexibility that can be freely bended by external force is required. Some chlorine-free copper foils have a certain degree of smoothness and flexibility, but further improvement in smoothness and flexibility is required. Although a copper foil typically has a characteristic of reduce in a tensile strength to increase flexibility by annealing, an electrodeposited copper foil tends to have a relatively higher tensile strength, that is, lower flexibility, after annealing (for example, 180° C. for 1 hour) than a rolled copper foil. Thus, an electrodeposited copper foil having a significantly low tensile strength (that is, high flexibility) after annealing is desired. However, an electrodeposited copper foil having a low roughness surface with ten-point average roughness Rz of 0.1 μm or larger and 2.0 μm or smaller has difficulty in regulating a tensile strength after annealing, and achievement of both smoothness and flexibility is not easy at present.

The present inventors have found that it is possible to provide an electrodeposited copper foil having high smoothness given by a ten-point average roughness Rz of 0.1 μm or larger and 2.0 μm or smaller and at the same time exhibiting high flexibility (particularly, high flexibility after annealing at 180° C. for 1 hour) suitable for a flexible substrate.

Accordingly, an object of the present invention is to provide an electrodeposited copper foil having high smoothness and at the same time exhibiting high flexibility (particularly, high flexibility after annealing at 180° C. for 1 hour) suitable for a flexible substrate.

According to an aspect of the present invention, there is provided an electrodeposited copper foil having a ten-point average roughness Rz of 0.1 μm or larger and 2.0 μm or smaller on at least one surface, wherein in an unannealed original state, the electrodeposited copper foil has a tensile strength measured in accordance with IPC-TM-650 of 56 kgf/mm$^2$ or more and less than 65 kgf/mm$^2$, and wherein after annealing at 180° C. for 1 hour, the electrodeposited copper foil has a tensile strength measured in accordance with IPC-TM-650 of 15 kgf/mm$^2$ or more and less than 25 kgf/mm$^2$.

According to another aspect of the present invention, there is provided a flexible substrate, comprising the electrodeposited copper foil.

DESCRIPTION OF EMBODIMENTS

Definitions

Figure 1:
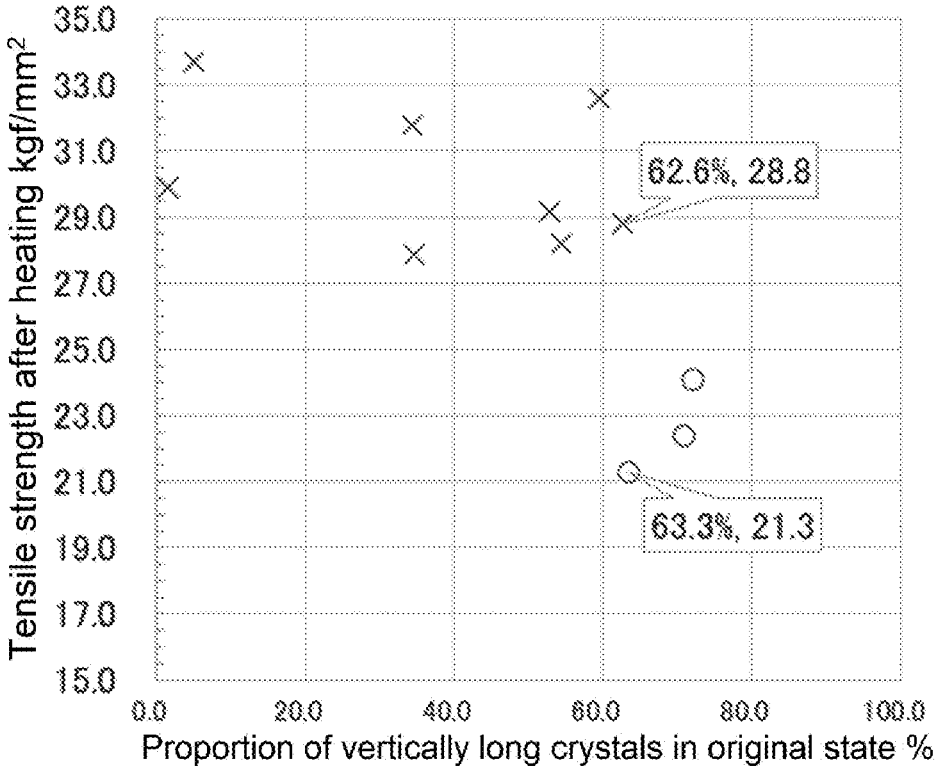
FIG. 1 is a graph indicating a relationship between proportion of vertically long crystals and tensile strength after heating in electrodeposited copper foils obtained in Examples 1 to 11.
Figure 2:
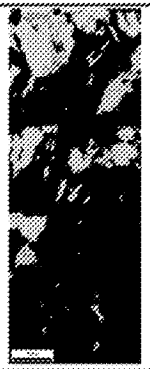
FIG. 2 is cross-sectional EBSD images (IQ+IPF map (in ND direction) of the electrodeposited copper foils obtained in Examples 1 to 11.
Figure 2:
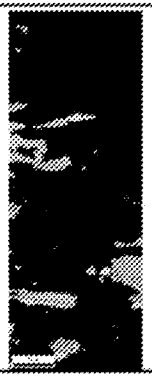
Figure 2:
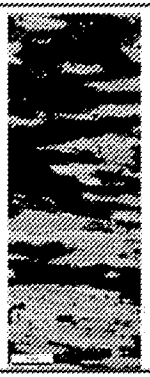
Figure 2:
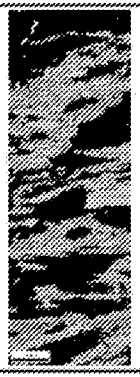
Figure 2:
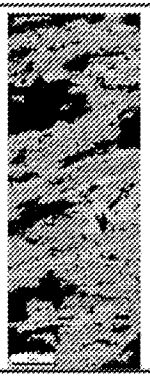
Figure 2:
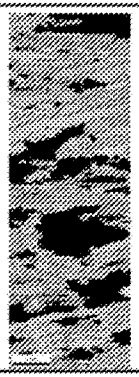
Figure 2:
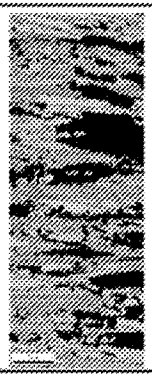
Figure 2:
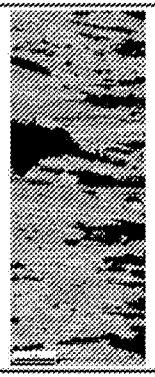
Figure 2:
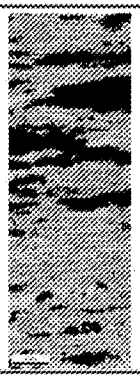
Figure 2:
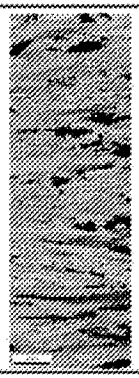
Figure 2:
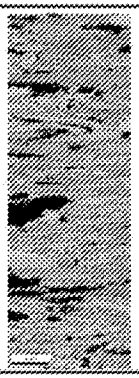

An "electrode surface" of an electrodeposited copper foil herein is referred to a surface that was contacted with a cathode during manufacture of the electrodeposited copper foil.

A "deposit surface" of an electrodeposited copper foil herein is referred to a surface on which electrodeposited copper is deposited, that is, a surface that was not contacted with the cathode during manufacture of the electrodeposited copper foil.

Electrodeposited Copper Foil

A copper foil according to the present invention is an electrodeposited copper foil. This electrodeposited copper foil has a ten-point average roughness Rz of 0.1 μm or larger and 2.0 μm or smaller on at least one surface. The electrodeposited copper foil has a tensile strength measured in accordance with IPC-TM-650 of 56 kgf/mm$^2$ or more and less than 65 kgf/mm$^2$ in an unannealed original state, and further a tensile strength measured in accordance with IPC-TM-650 of 15 kgf/mm$^2$ or more and less than 25 kgf/mm$^2$ after annealing at 180° C. for 1 hour. The present invention can thus provide an electrodeposited copper foil having high smoothness given by a ten-point average roughness Rz of 0.1 μm or larger and 2.0 μm or smaller and at the same time exhibiting high flexibility (particularly, high flexibility after annealing at 180° C. for 1 hour) suitable for a flexible substrate.

As described above, although a copper foil typically has the characteristic that annealing results in a decreased tensile strength and an increased flexibility, an electrodeposited copper foil tends to have a relatively higher tensile strength, that is, a lower flexibility than a rolled copper foil after annealing (for example, 180° C. for 1 hour). Thus, an electrodeposited copper foil having a significantly low tensile strength (that is, high flexibility) after annealing is desired. However, an electrodeposited copper foil having a low roughness surface with ten-point average roughness Rz of 0.1 μm or larger and 2.0 μm or smaller has difficulty in regulating a tensile strength after annealing, and achievement of both smoothness and flexibility is not easy at present. From this viewpoint, the electrodeposited copper foil of the present invention can conveniently achieve both the smoothness and the flexibility.

The electrodeposited copper foil has a ten-point average roughness Rz, on at least one surface, of preferably 0.1 μm or larger and 2.0 μm or smaller, more preferably 0.3 μm or larger and 2.0 μm or smaller, further preferably 0.3 μm or larger and 1.8 μm or smaller, particularly preferably 0.6 μm or larger and 1.5 μm or smaller, and most preferably 0.6 μm or larger and 1.2 μm or smaller. Such an electrodeposited copper foil having a low roughness surface is advantageous from the viewpoint of less rupture starting points. The "ten-point average roughness Rz" herein is measured in accordance with JIS-B0601:1982, and corresponds to Rzjis in JIS-B0601:2001.

The electrodeposited copper foil also preferably has a ten-point average roughness Rz within the above range on both surfaces. That is, the electrodeposited copper foil has a ten-point average roughness Rz, on both the surfaces, of preferably 0.1 μm or larger and 2.0 μm or smaller, more preferably 0.3 μm or larger and 2.0 μm or smaller, further preferably 0.3 μm or larger and 1.8 μm or smaller, particularly preferably 0.6 μm or larger and 1.5 μm or smaller, and most preferably 0.6 μm or larger and 1.2 μm or smaller. Such an electrodeposited copper foil having low roughness surfaces on both the surfaces is advantageous from the viewpoint of less rupture starting points.

The electrodeposited copper foil in an unannealed original state has a tensile strength of 56 kgf/mm$^2$ or more and less than 65 kgf/mm$^2$, preferably 57 kgf/mm$^2$ or more and 64 kgf/mm$^2$ or less, more preferably 59 kgf/mm$^2$ or more and 64 kgf/mm$^2$ or less, and further preferably 60 kgf/mm$^2$ or more and 64 kgf/mm$^2$ or less. The electrodeposited copper foil after annealing at 180° C. for 1 hour has a tensile strength of 15 kgf/mm$^2$ or more and less than 25 kgf/mm$^2$, preferably 15 kgf/mm$^2$ or more and 24.5 kgf/mm$^2$ or less, more preferably 16 kgf/mm$^2$ or more and 24.5 kgf/mm$^2$ or less, and further preferably 16 kgf/mm$^2$ or more and 24 kgf/mm$^2$ or less. Within the above range, the electrodeposited copper foil can exhibit high flexibility suitable for a flexible substrate when a thermal history is applied by annealing (for example, 180° C. for 1 hour). Both of the tensile strength in an unannealed original state and the tensile strength after annealing are measured in accordance with IPC-TM-650 at a room temperature (for example, 25° C.).

When a cross section of the electrodeposited copper foil of the present invention is evaluated, it typically has a high proportion occupied by vertically long columnar crystals longitudinally extending in the foil thickness direction (hereinafter, referred to as vertically long crystals). This fine structure rich in the vertically long crystals is presumed to contribute to both of the high smoothness of a ten-point average roughness Rz of 0.1 μm or larger and 2.0 μm or smaller and the high flexibility (particularly, the high flexibility after annealing at 180° C. for 1 hour) suitable for a flexible substrate. The vertically long crystals are specified as satisfying the following conditions when a cross section of the electrodeposited copper foil is analyzed by electron backscatter diffraction (EBSD). The conditions are as follows:

i) (101) orientation;
ii) an aspect ratio of 0.500 or less;
iii) $|\sin\theta|$ of 0.001 or more and 0.707 or less, where θ(°) is an angle between a normal to an electrode surface of the electrodeposited copper foil and a major axis of the copper crystal grain; and
iv) when the crystal is elliptically approximated, a length of a minor axis of 0.38 μm or smaller.

In cross-sectional analysis by EBSD, the electrodeposited copper foil of the present invention has a proportion of an area occupied by the copper crystal grains satisfying all the above conditions i) to iv) to an area of an observation field (for example, 10 μm in width×28 μm in height) occupied by copper crystal grains (that is, the proportion of the vertically long crystals) of preferably 63% or more, more preferably 63% or more and 90% or less, further preferably 63% or more and 85% or less, particularly preferably 63% or more and 80% or less, and most preferably 63% or more and 75% or less. Within the above range, preferably achieved is both of the high smoothness of a ten-point average roughness Rz of 0.1 μm or larger and 2.0 μm or smaller and the high flexibility (particularly, the high flexibility after annealing at 180° C. for 1 hour) suitable for a flexible substrate. Here, the observation field in EBSD specifies a rectangular region of width×height satisfying conditions shown in Table 1.

TABLE 1

| EBSD observation field | Correspondence to copper foil | Specific size |
|---|---|---|
| Width | Length in thickness direction of copper foil | distance from $E_0$ to $E_1$ in the thickness direction of the copper foil ($E_1 - E_0$) where: $E_0$ is a field end at a position distanced by 3 μm from the electrode surface of the copper foil in the thickness direction; and $E_1$ is an opposite field end nearest to the deposition surface of the copper foil when a largest range of an observation field full of copper crystals is incorporated within one field |
| Height | Length in surface direction of copper foil | 28 μm in the surface direction of the copper foil |

With specifying the width in the EBSD observation field, a position 3 μm apart from the electrode surface of the copper foil in the thickness direction is specified as a reference position $P_0$ (that is, a region within 3 μm from the electrode surface of the copper foil in the thickness direction is excluded from the field). This is because such exclusion of the surface layer region on the side in which the copper crystal grains become relatively or excessively fine due to influence of the cathode (particularly the structure thereof) used during manufacture of the electrodeposited copper foil provides the EBSD observation field more representatively reflecting a major component in the thickness direction of the copper foil.

The EBSD analysis can be performed by subjecting the electrodeposited copper foil to a cross-section polisher (CP) process to form a polished cross section, and by EBSD-analyzing the polished cross section within an observation field with width×height shown in Table 1 by using an EBSD apparatus (SUPRA55VP, manufactured by Carl Zeiss Co., Ltd.) under SEM conditions of Vacc.=20 kV, Apt.=60 μm, H.C. mode, Tilt=70°, and Scan Phase=Cu.

The proportion of the vertically long crystals can be determined based on the EBSD image through the following steps.

Primary Extraction Based on the Condition i):

The EBSD image in the observation field is analyzed by using an EBSD analysis software (OIM Analysis 7, available from TSL solutions K. K.) to extract crystals orientating in (h, k, l)=(1, 0, 1) (see Examples below for detailed setting conditions). This procedure extracts a crystal grain region satisfying the above condition i).

Secondary Extraction Based on the Conditions ii), iii), and iv):

Further extracted based on the data obtained from the primary extraction is a crystal satisfying all the conditions of: an aspect ratio of 0.500 or less; a gradient of a major axis |sin θ| of 0.001 or more and 0.707 or less; and when the crystal grain is elliptically approximated, a length of a minor axis of 0.38 μm or smaller (see Examples below for detailed setting conditions). A summed area ($\mu m^2$) of the above crystals is obtained as an area of the vertically long crystal grains. This procedure extracts a crystal grain region satisfying the above conditions ii), iii), and iv).

Calculation of Proportion of Vertically Long Crystals:

Using the area $S_{VC}$ ($\mu m^2$) of the vertically long crystal grains obtained in the secondary extraction and an area $S_{OA}$, ($\mu m^2$) of the observation field, a proportion occupied by the vertically long crystal grains relative to the area occupied by the copper crystal grains is calculated with a formula of $100 \times S_{VC}/S_{OA}$ to be specified as the proportion of the vertically long crystals (%) (see Examples below for setting conditions).

A thickness of the electrodeposited copper foil is not particularly limited, but preferably 5 μm or more and 35 μm or less, more preferably 7 μm or more and 35 μm or less, further preferably 9 μm or more and 18 μm or less, and particularly preferably 12 μm or more and 18 μm or less.

The electrodeposited copper foil is preferably subjected to surface treatment on one surface or on both surfaces. This surface treatment may be one commonly performed in electrodeposited copper foils. Preferable examples of the surface treatment include roughening treatment, rust proofing treatment (for example, zinc plating treatment and zinc-alloy plating treatment such as zinc-nickel-alloy plating treatment), and silane coupling agent treatment. The electrodeposited copper foil may be provided as a form of a carrier-attached copper foil.

Manufacturing Method

The electrodeposited copper foil of the present invention can be manufactured by using a copper electrolyte (aqueous solution) with a copper (Cu) concentration, sulfuric acid ($H_2SO_4$) concentration, and chlorine (Cl) concentration shown in Table 2, and by maintaining a bath temperature (temperature of the aqueous solution) at a temperature shown in Table 2 to perform electrodeposition at a current density shown in Table 2. That is, by satisfying these conditions of the copper electrolyte composition, bath temperature, and current density, it is possible to manufacture the electrodeposited copper foil having the high smoothness given by a ten-point average roughness Rz of 0.1 μm or larger and 2.0 μm or smaller on the deposited surface (or both of the deposited surface and the electrode surface) and at the same time exhibiting the high flexibility (particularly, the high flexibility after annealing at 180° C. for 1 hour) suitable for a flexible substrate. As shown in Table 2, the copper electrolyte used in this manufacturing method is desirably a chlorine-free electrolyte containing chlorine as low as possible.

TABLE 2

| | Composition of aqueous solution (copper electrolyte) | | | | |
|---|---|---|---|---|---|
| | Copper concentration | Sulfuric acid concentration | Chlorine concentration | Bath temperature | Current density |
| Preferable range | 30 g/L or higher<br>50 sg/L or lower | 150 g/L or higher<br>210 g/L or lower | 0 mg/L or higher<br>5 mg/L or lower | 31° C. or higher<br>lower than 33° C. | 35 A/dm$^2$ or higher<br>45 A/dm$^2$ or lower |
| More preferable range | 35 g/L or higher<br>50 g/L or lower | 155 g/L or higher<br>210 g/L or lower | 0 mg/L or higher<br>5 mg/L or lower | 31° C. or higher<br>lower than 33° C. | 37.5 A/dm$^2$ or higher<br>45 A/dm$^2$ or lower |
| Further preferable range | 40 g/L or higher<br>50 g/L or lower | 160 g/Lor higher<br>210 g/L or lower | 0 mg/L or higher<br>5 mg/L or lower | 31° C. or higher<br>lower than 33° C. | 40 A/dm$^2$ or higher<br>45 A/dm$^2$ or lower |

EXAMPLES

The present invention will be described in more specific with the following examples.

Examples 1 to 11

(1) Manufacture of Electrodeposited Copper Foil

A sulfuric acid-acidic copper sulfate solution (no chlorine was added) with a composition shown in Table 4 was used as the copper electrolyte. A plate-shaped electrode (surface roughness Ra=0.19 μm in accordance with JIS-B0601:1982) made of titanium was used as a cathode, and a DSA (dimensionally stable anode) was used as an anode. Electrodeposition was performed at a bath temperature and at a current density shown in Table 4 to obtain an electrodeposited copper foil having a thickness of 18 μm.

(2) Evaluation of Electrodeposited Copper Foil

On the obtained electrodeposited copper foil, measurement of ten-point average roughness Rz, cross-sectional analysis by EBSD, and measurement of tensile strength were performed as follows.

<Measurement of Ten-Point Average Roughness Rz>

A ten-point average roughness Rz (corresponding to Rzjis in JIS-B0601:2001) on a deposited surface of the electrodeposited copper foil was measured by using a surface roughness measuring instrument (Surfcorder SE-30H, manufactured by Kosaka Laboratory Ltd.) in accordance with JIS-B0601:1982 under conditions of λc: 0.8 μm, reference length: 0.8 mm, and feeding speed: 0.1 mm/s. Table 4 shows results.

<Proportion of Vertically Long Crystals and EBSD Cross-Sectional Analysis>

Four samples of the electrodeposited copper foil were overlapped to be laminated with an adhesive (LOCTITE®, manufactured by Henkel Japan Ltd.), and then an ultraviolet-curable resin was applied on the sample surface as a protecting layer. The sample was entirely coated with carbon, then subjected to cross-sectional process with broad argon ion beam (CROSS SECTION POLISHER® (CP), manufactured by JEOL Ltd.) (accelerating voltage: 5 kV) for 3 hours to obtain a polished cross section for EBSD measurement. With EBSD observation, carbon coating (1 flash) was performed. The polished cross section was EBSD-analyzed by using an EBSD apparatus (FE-SEM apparatus (SUPRA55VP, manufactured by Carl Zeiss Co., Ltd.) equipped with an EBSD measuring apparatus (Pegasus, manufactured by AMETEK, Inc.)) under SEM conditions of Vacc.=20 kV, Apt.=60 μm, H.C. mode, Tilt=70°, and Scan Phase=Cu. The observation field in the EBSD was set to 10 μm in width×28 μm in height (in accordance with the above conditions shown in Table 1). In the EBSD image in the observation field, an area occupied by copper crystal grains satisfying all of the following conditions (hereinafter, referred to as an area of vertically long crystal grains) was determined by the following primary extraction and secondary extraction. The conditions are as follows:

i) (101) orientation;

ii) an aspect ratio of 0.500 or less;

iii) |sin θ| of 0.001 or more and 0.707 or less, where θ(°) is an angle between a normal line of the electrode surface of the electrodeposited copper foil and a major axis of the copper crystal grain; and iv) when the crystal is elliptically approximated, a length of a minor axis of 0.38 μm or smaller.

Primary Extraction Based on the Condition i)

The EBSD image in the observation field is analyzed by using an EBSD analysis software (OIM Analysis 7, available from TSL solutions K. K.) to extract crystals orientating in (hkl)=(101). A specific procedure was as follows. In a screen of OIM Analysis 7, [All data], [Property], [Crystal Orientation], and [(h,k,l)=(1,0,1)] was selected. Then, a value of [Deviation] was set to be less than 60, (h,k,l)=(1, 0,1) was selected in [Crystal Deviation], and then a value of [Derivation] was set to be less than 12 to extract [Grain data], that is, particle data. In this time, setting conditions of OIM Analysis 7 were as follows.

PCO [Copper, 0.000, 45.000, 90.000]<60

AND PCD [Copper, 1, 0, 1, 0, 0, 1]<12

Secondary Extraction Based on the Conditions ii), iii), and iv)

Further extracted based on the data obtained in the above were crystals satisfying all the conditions of: an aspect ratio of 0.500 or less; a gradient of a major axis |sin θ| of 0.001 or more and 0.707 or less; and when the crystal grain is elliptically approximated, a length of a minor axis of 0.38 μm or smaller. A summed area ($\mu m^2$) of the above crystals was obtained as an area of the vertically long crystal grains. That is, setting conditions of OIM Analysis 7 were shown as in Table 3.

TABLE 3

| | | |
|---|---|---|
| Aspect ratio | Aspect ratio of ellipse fit to grain | <=0.5 |
| Gradient of major axis \|sinθ\|* | Orientation (relative to the horizontal) of major axis of ellipse fit to grain in degrees | <=0.707 |
| Minor axis of ellipse | Length of minor axis of ellipse fit to grain in microns | <=0.38 |

*θ <= 45 and θ >= 135

Calculation of Proportion of Vertically Long Crystals:

Using the area $S_{VC}$ ($\mu^2$) of the vertically long crystal grains obtained in the primary extraction and the secondary extraction and an area $S_{OA}$ ($\mu m^2$) of the observation field, a proportion occupied by the vertically long crystal grains relative to the area occupied by the copper crystal grains was calculated with a formula of $100 \times S_{VC}/S_{OA}$ to be specified as the proportion of the vertically long crystals (%). Table 4 shows results.

<Measurement of Original Tensile Strength>

A sample of the electrodeposited copper foil without annealing was cut in a size of 10 mm×100 mm to obtain a specimen. This specimen was set in a measuring apparatus (AGI-1KNM1, manufactured by SHIMADZU CORPORATION) to measure an original tensile strength at a room temperature (approximately 25° C.) in accordance with IPC-TM-650 under conditions of tensile speed: 50 mm/min and full-scale test force: 50 N. Table 4 shows results.

<Measurement of Tensile Strength after Heating>

A sample of the electrodeposited copper foil after annealing at 180° C. for 1 hour was cut in a size of 10 mm×100 mm to obtain a specimen. A tensile strength of this specimen was measured under the same conditions as in the measurement of the original tensile strength to measure a tensile strength after heating. Table 4 shows results.

TABLE 4

| | Electrodeposited copper foil | | | | | | | |
|---|---|---|---|---|---|---|---|---|
| | Manufacturing conditions | | | | | EBSD cross-sectional analysis | | |
| | Composition of copper electrolyte (no chlorine is added) | | | | | | Tensile strength | |
| | Copper concentration (g/L) | Sulfuric acid concentration (g/L) | Bath temperature (° C.) | Current density ($A/dm^2$) | Rz (μm) | Proportion of vertically long crystals (%) | Original state ($kgf/mm^2$) | After heating ($kgf/mm^2$) |
| Example 1 | 40 | 160 | 31 | 40 | 0.79 | 70.8 | 58.9 | 22.4 |
| Example 2 | 50 | 160 | 31 | 45 | 1.23 | 72.0 | 61.0 | 24.1 |

TABLE 4-continued

| | Manufacturing conditions | | | | Electrodeposited copper foil | | | |
|---|---|---|---|---|---|---|---|---|
| | Composition of copper electrolyte (no chlorine is added) | | | | | EBSD cross-sectional analysis | | |
| | | | | | | Proportion | Tensile strength | |
| | Copper concentration (g/L) | Sulfuric acid concentration (g/L) | Bath temperature (° C.) | Current density (A/dm$^2$) | Rz (μm) | of vertically long crystals (%) | Original state (kgf/mm$^2$) | After heating (kgf/mm$^2$) |
| Example 3 | 50 | 210 | 31 | 45 | 1.07 | 63.3 | 63.3 | 21.3 |
| Example 4* | 40 | 110 | 39 | 35 | 2.31 | 5.0 | 42.4 | 33.7 |
| Example 5* | 40 | 160 | 35 | 40 | 1.56 | 34.5 | 45.4 | 31.8 |
| Example 6* | 50 | 210 | 35 | 45 | 1.68 | 34.6 | 56.7 | 27.9 |
| Example 7* | 50 | 210 | 50 | 45 | 0.48 | 1.7 | 77.4 | 29.9 |
| Example 8* | 50 | 210 | 43 | 45 | 0.55 | 52.8 | 56.8 | 29.2 |
| Example 9* | 50 | 210 | 33 | 45 | 1.13 | 54.5 | 51.7 | 28.2 |
| Example 10* | 30 | 110 | 47 | 45 | 2.04 | 59.5 | 47.4 | 32.6 |
| Example 11* | 30 | 110 | 35 | 35 | 1.98 | 62.6 | 46.5 | 28.8 |

The symbol * represents a comparative example.

The invention claimed is:

1. An electrodeposited copper foil having a ten-point average roughness Rz of 0.1 μm or larger and 2.0 μm or smaller on at least one surface, wherein in an unannealed original state, the electrodeposited copper foil has a tensile strength measured in accordance with IPC-TM-650 of 56 kgf/mm$^2$ or more and less than 65 kgf/mm$^2$, and wherein after annealing at 180° C. for 1 hour, the electrodeposited copper foil has a tensile strength measured in accordance with IPC-TM-650 of 15 kgf/mm$^2$ or more and less than 25 kgf/mm$^2$.

2. The electrodeposited copper foil according to claim 1, wherein the electrodeposited copper foil has a ten-point average roughness Rz of 0.1 μm or larger and 2.0 μm or smaller on both surfaces.

3. The electrodeposited copper foil according to claim 1, wherein in cross-sectional analysis by electron backscatter diffraction (EBSD), a proportion of an area occupied by copper crystal grains satisfying all of the following conditions:

i) (101) orientation;

ii) an aspect ratio of 0.500 or less;

iii) $|\sin\theta|$ of 0.001 or more and 0.707 or less, where θ (°) is an angle between a normal to an electrode surface of the electrodeposited copper foil and a major axis of the copper crystal grain; and iv) when the crystal is elliptically approximated, a length of a minor axis of 0.38 μm or smaller, to an area of an observation field occupied by copper crystal grains is 63% or more.

4. A flexible substrate, comprising the electrodeposited copper foil according to claim 1.

* * * * *